US006378732B1

(12) United States Patent
Park

(10) Patent No.: US 6,378,732 B1
(45) Date of Patent: Apr. 30, 2002

(54) TUBE SQUEEZING DEVICE

(76) Inventor: Rodney William Park, 4 Links Drive, Pinelands, Cape Town (ZA)

( * ) Notice: Subject to any disclaimer, the term of this patent is extended or adjusted under 35 U.S.C. 154(b) by 0 days.

(21) Appl. No.: 09/705,631

(22) Filed: Nov. 3, 2000

(30) Foreign Application Priority Data

Nov. 5, 1999 (ZA) ..... 99/6952

(51) Int. Cl.[7] ..... B65D 35/28
(52) U.S. Cl. ..... 222/102
(58) Field of Search ..... 222/101, 102

(56) References Cited

U.S. PATENT DOCUMENTS 2,578,472 A * 12/1951 Gunnarson ..... 222/101
2,642,205 A * 6/1953 Lane ..... 222/102
2,690,858 A * 10/1954 Peralta et al. ..... 222/101
3,313,454 A 4/1967 Welsh et al.
3,501,054 A 3/1970 Maurice
4,337,879 A 7/1982 Park
5,447,255 A * 9/1995 Smedley ..... 222/102
5,875,929 A * 3/1999 Nguyen ..... 222/102
5,957,334 A * 9/1999 Rosario ..... 222/102
6,089,405 A * 7/2000 Schmitt ..... 222/102

* cited by examiner

*Primary Examiner*—Philippe Derakshani
*Assistant Examiner*—Thach H Bui
(74) *Attorney, Agent, or Firm*—Alston & Bird LLP

(57) ABSTRACT

A tube squeezing device comprises a rectangular housing having a longitudinal slot formed in its front wall. The housing is pivoted to a backing plate which includes a tube retaining base for receiving and clamping the neck of the tube. A slide is arranged to slide within the housing, with the first and second rollers being mounted to the carriage. Each roller is provided with a slide advancing face and a tube squeezing face which are substantially perpendicular to each other, with a serrated and curved tube gripping face extending therebetween. The slide advancing faces define a nip which is slightly wider than a squeezed portion of the tube, thereby allowing the slide to move to a position in which the gripping faces or each roller abut the tube shoulders at the commencement of the unsqueezed portion of tube. Upon downward actuation of a lever, the rollers counter-rotate towards one another so that material from an adjacent unsqueezed portion of the tube may be squeezed.

5 Claims, 4 Drawing Sheets

FIG. 1.
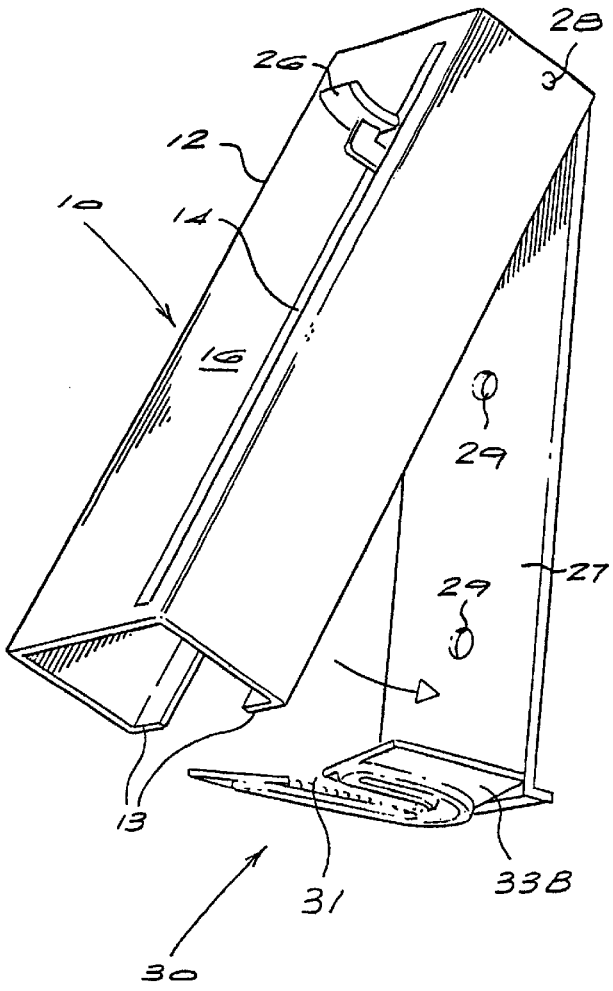
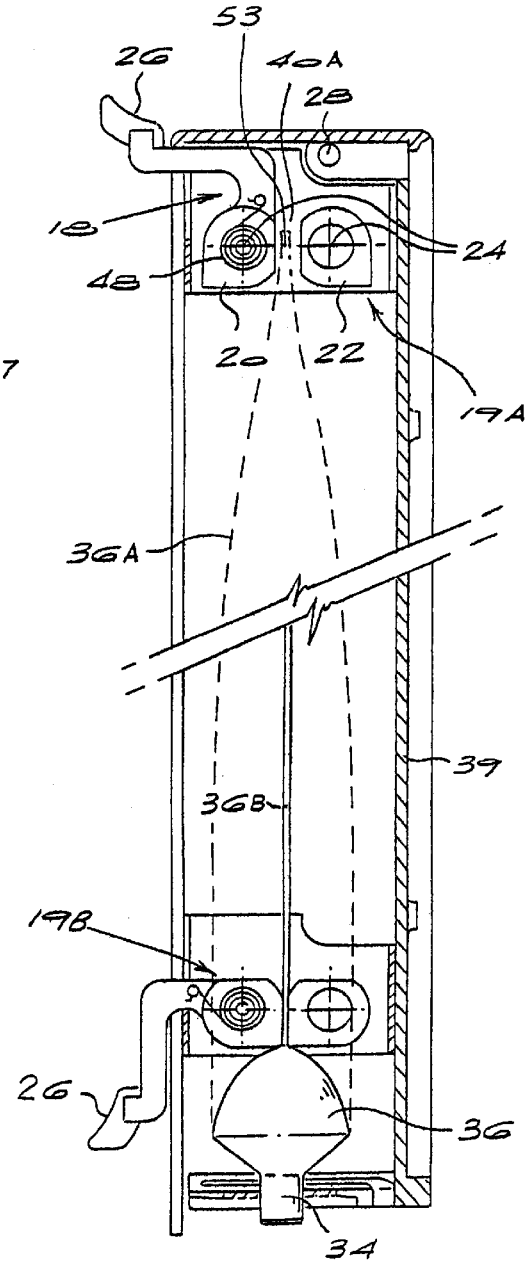
FIG. 2.

FIG. 2A.
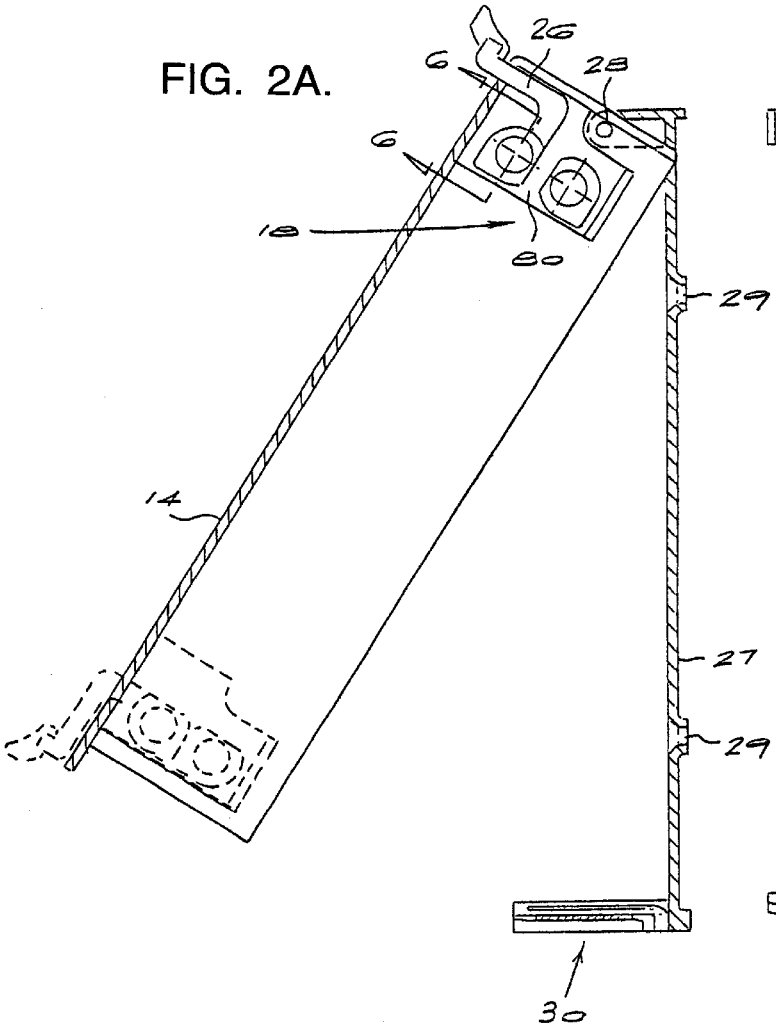
FIG. 2B.
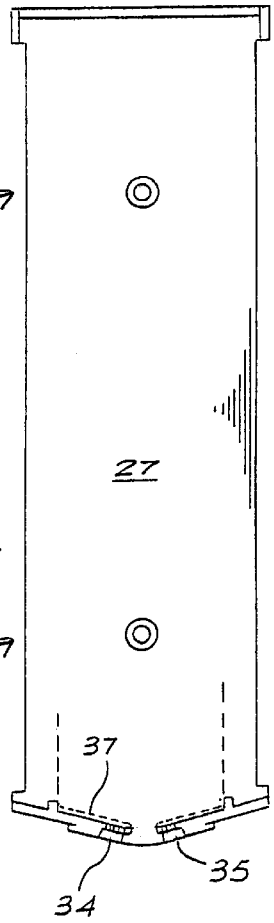
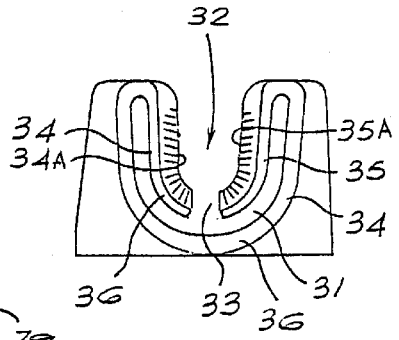
FIG. 2C.
FIG. 6.
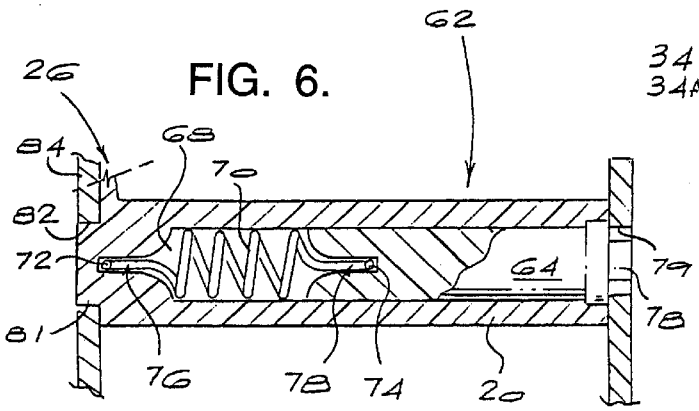

TUBE SQUEEZING DEVICE

BACKGROUND OF THE INVENTION

THIS invention relates to a tube squeezing device for squeezing deformable tube containers such as toothpaste tubes.

One problem encountered with toothpaste tubes and the like is that they are squeezed randomly in such a fashion that not all of the contents are dispensed, and the remaining contents are wasted when disposed of in the mangled tube.

U.S. Pat. No. 4,337,879 discloses one type of squeezing device which aims to overcome this problem. One drawback associated with the squeezing device of this patent is that it does not provide for differences in thickness between metal and plastic tubes. Further, it generally does not rid the tube of those contents which are in the region of the neck of the tube.

SUMMARY OF THE INVENTION

According to the invention there is provided a device for squeezing a deformable tube having a closed end and a nozzle end and containing a material to be dispensed, the device including:

- a housing;
- mounting means for mounting the tube relative to the housing;
- a slide arranged to be moved along a linear path defined in the housing;
- a first roller mounted rotatably on the slide about an axis perpendicular to the direction of movement of the slide;
- a second opposed roller mounted rotatably on the slide about an axis substantially parallel to the axis of the first roller;
- activating means for allowing the rollers to rotate simultaneously towards one another from a roller advancing position to a tube squeezing position, wherein each of the first and second rollers have first and second respective cammed faces defining in combination a slide advancing nip in the roller advancing position for allowing the rollers to advance relative to a squeezed portion of the tube and a tube squeezing nip in the tube squeezing position, the tube squeezing nip being narrower than the slide advancing nip, for squeezing the material from an adjacent unsqueezed portion of the tube.

Typically, a tube gripping nip is defined between the advancing nip and the tube squeezing nip.

Conveniently, the slide advancing nip is defined by a pair of opposed and substantially parallel slide advancing faces formed on the first and second rollers.

Preferably, the tube squeezing nip is defined by a pair of opposed and substantially parallel tube squeezing faces formed on the first and second rollers, the tube squeezing faces extending substantially transversely relative to the slide advancing faces.

Advantageously, the tube gripping nip is defined by a pair of tube gripping faces extending between the slide advancing faces and the tube squeezing faces, with the tube gripping faces including tube gripping formations for gripping the tube firmly as the tube squeezing faces are rotated towards one another.

Typically, the tube gripping formations are toothed or serrated formations and are arranged to crimp the tube therebetween, with the teeth of the tube gripping faces at least partly enmeshing.

Conveniently, the tube squeezing faces are relatively smooth for allowing the slide to be advanced when the tube squeezing faces are opposed, so as to evacuate the tube contents in the region of the neck of the tube.

Preferably, the device includes biasing means for biasing the rollers to an inoperative position in which the slide advancing faces of each roller lie adjacent the squeezed portion of the tube.

Advantageously, the activating means includes an activating lever for rotating the first roller and co-acting means for allowing the first roller to rotate the second roller so that both rollers rotate simultaneously towards one another.

The co-acting means preferably includes intermeshing teeth on the rollers, the teeth being arranged to co-operate to allow both rollers to rotate simultaneously.

Conveniently, the housing is pivotably mounted to a backing plate, the backing plate including a tube retaining base for receiving the neck of the tube.

Typically, the tube retaining base includes a pair of inwardly projecting arms, the arms being arranged to resiliently splay downwardly and outwardly when the neck of the tube is inserted therein so as to clamp the neck of the tube firmly in position.

BRIEF DESCRIPTION OF THE DRAWINGS

FIG. 1 shows a perspective view of a tube squeezing device of the invention;

FIG. 2 shows a partly cross-sectional side view of the tube squeezing device of FIG. 1 with a toothpaste tube mounted in position;

FIG. 2A shows a partly cross sectional side view of the tube squeezing device of FIG. 2 in the raised position;

FIG. 2B shows a front view of a backing plate forming part of the tube squeezing device of the invention;

FIG. 2C shows an underplan view of a tube retaining base projecting from the backing plate;

FIG. 6 shows a partly cross-sectional side view on the line 6—6 of FIG. 2A.

DESCRIPTION OF EMBODIMENTS

Figure 3A:
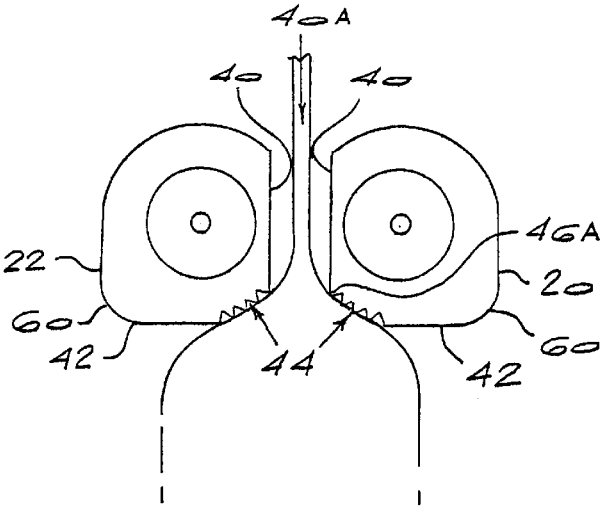
FIGS. 3A to 3E show schematic side views of various stages in squeezing out toothpaste in the tube which is located towards the nozzle end of the tube.
Figure 3B:
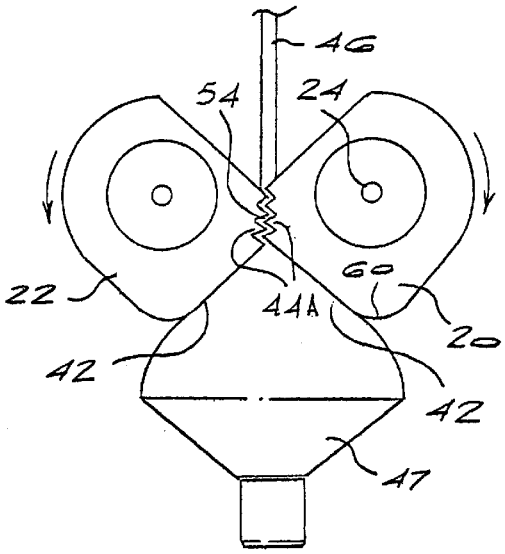
Figure 3C:
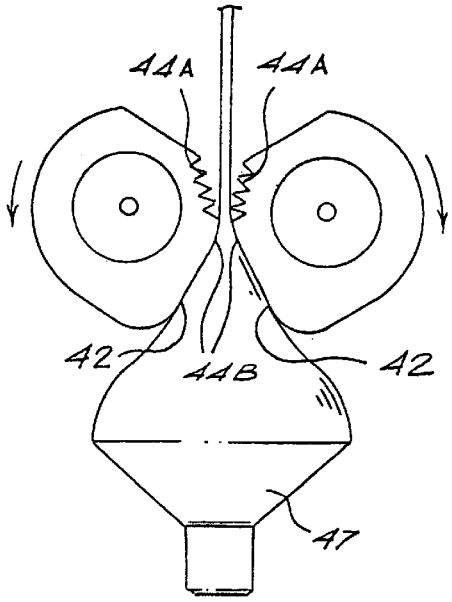
Figure 3D:
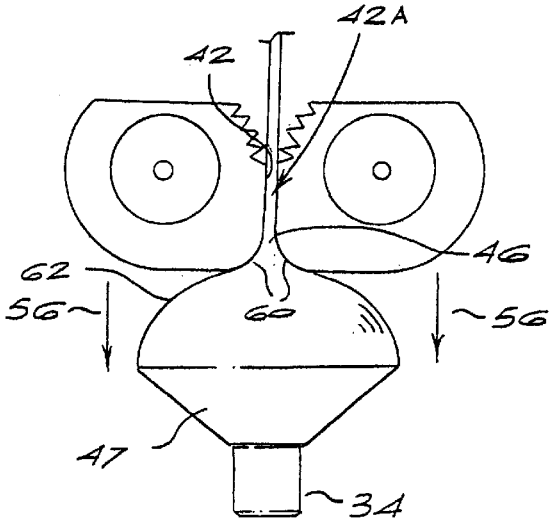

Referring first to FIGS. 1, 2 and 2A of the drawings a tube squeezing device of the invention 10 comprises a rectangular housing 12 in the form of a channel having re-entrant lips 13 and a longitudinal slot 14 formed in a front wall 16 of the housing. A slide or carriage 18 is arranged to slide up and down within the housing 12 along a major axis thereof from a fully raised position 19A to a lowered position 19B. First and second rollers 20 and 22 are journalled to the slide 18 on stub axles 24, and an actuating handle 26 is secured to the first roller 20 and extends through the slot 14.

The housing is pivoted to a backing plate 27 on stub axles 28. The backing plate is provided with screw holes 29 for mounting the plate to a wall or the like. Projecting from the lowermost edge of the backing plate 27, and illustrated more clearly in FIGS. 2B and 2C, is a tube retaining base 30. The base 30 includes an inner U-shaped cut-out 31 and an outer serrated U-shaped recess 32 joined by a central slot 33 so as to define a pair of inwardly projecting half U-shaped arms 34 and 35. An inner peripheral rib 36 extends around the U-shape cut-out 31, and reinforces the arms 34 and 35. In use, the neck of the toothpaste tube is clamped into position by gripping the cap of the tube and pressing that portion of the neck of the tube immediately above the cap into the indent 32. The arms 34 and 35 resiliently splay downwardly and outwardly so as to create a clamping effect, with the serrated outer edges 34A and 35A of the respective arms 34 and 35 clamping the neck of the tube firmly in position. The shallow V-shaped profile of the two halves of the tube retaining base allow the tapered skirt of the tube adjacent its neck to nest snugly within the tube retaining base 30 when the neck is clamped in position, as is shown in broken outline at 37.

Referring now to FIGS. 3A to 3D, each roller 20 and 22 is provided with a carriage or slide advancing face 40 and a tube squeezing face 42 which is substantially perpendicular to the carriage advancing face 40. A serrated and curved tube gripping face 44 on each roller extends between the carriage advancing face 40 and the tube squeezing face 42, with the gripping faces 44 being formed with a series of parallel partly enmeshing teeth 44A. The roller 20 is biased by means of a coiled clock spring 48, shown clearly in FIG. 2, to an inoperative position in which the carriage advancing faces 40 of each roller lie adjacent the squeezed portion 46 of the toothpaste tube. The carriage advancing faces 40 define a nip 40A which is slightly wider than the squeezed portion 48, thereby allowing the carriage to slide to a position on which the curved griping faces 44 of each roller abut the tube shoulders 46A at the commencement of the unsqueezed portion of tube.

Figure 4:
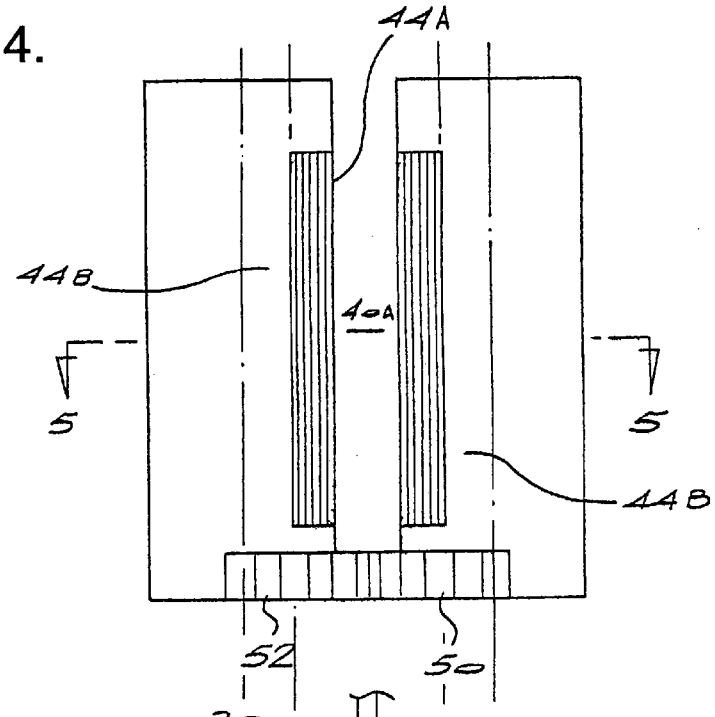
FIG. 4 shows an underplan view of the roller assembly in the FIG. 3A position.
Figure 5:
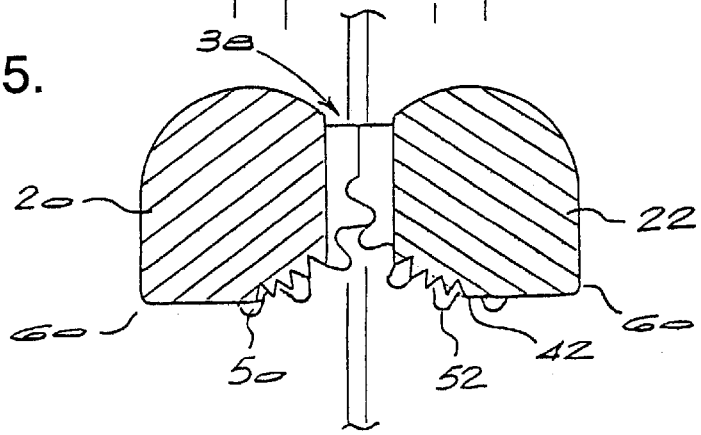
FIG. 5 shows a cross section on the line 5—5 of FIG. 4.

Referring now to FIGS. 4 and 5, the rollers 20 and 22 are provided with respective intermeshing toothed cog formations 50 and 52 which co-operate to allow both rollers to rotate simultaneously towards the nip 40A on downward actuation of the lever 26.

The tube squeezing device 10 of the invention is operated in the following manner. The tube is first loaded into the housing by raising the housing 12, inserting the rear end of the tube into the nip 40A between the rollers, pushing the tube and the slide which is now engaged with the tube upwards until only the neck 34 of the tube projects from the base of the housing 12, and inserting the neck of the tube so that it fits snugly into the U-shaped indent 32 in an interference or friction fit, with the slide 18 in the uppermost position 19A above the closed end 53 of the full tube, as is shown in FIG. 2.

The dispensing operation is commenced by removing the cap (not shown) of the tube and pulling downwardly on the handle 26 against the bias of the spring 48. Progressive downward movement of the handle 26 causes both rollers to rotate progressively in the manner illustrated in FIGS. 3A to 3D. As the operating handle 26 is pulled down, both rollers 20 and 22 rotate about their axes extending through the stub axles 24. It can clearly be seen in FIG. 3B how the teeth 44A of the gripping faces 44 partly enmesh with the tube crimped and gripped at 54 firmly therebetween. This gripping action serves to prevent the rollers from reversing or sliding backwards as the squeezing faces 42 are brought towards one another in the manner illustrated in FIGS. 3B and 3C. Once the desired amount of toothpaste has been ejected, the handle 26 is released and it is allowed to return under influence of the coil spring 46 to its rest position illustrated in FIG. 3. Once it has returned to this position, there is a squeezed portion 46 of tube beneath the rollers 20 and 22. The nip 40A between the slide or carriage rollers then falls under influence of gravity to a position in which the curved faces 44 of the rollers abut once more the downwardly migrated expanded shoulders 46A of the tube, at which stage the device is ready for dispensing a further amount of toothpaste.

When the squeezing faces 42 are operative, the gripping faces 44 have been rotated out of partly enmeshed engagement with one another. As a result, the smooth squeezing surfaces 42 slide slightly upwards relative to the surfaces of the tube within which they are in contact so as to dispense a controlled dosage of toothpaste or the like. This process is repeated by advancing the rollers downward in the direction of the arrows 56 so as to discharge the contents of the tube until the carriage is adjacent the neck and skirt of the container.

Figure 3E:
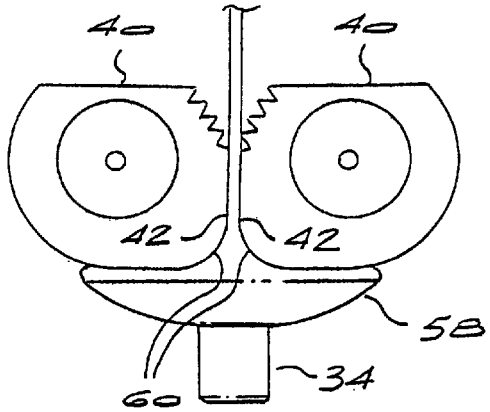

The squeezing faces 42 terminate in the pinching faces 60 which have a relatively small radius relative to the roller, thereby ensuring that the tube walls are pinched off effectively after each squeezing cycle, forcing the contents of the tube downwards towards the neck of the tube as can be seen in FIG. 3E, and ensuring that the contents do not escape upwardly through the nip in-between the rollers. In addition, the toothed cogs 50 and 52 ensure that the rollers co-operate together in squeezing out the tube contents.

Referring now to FIG. 6, an alternative version of a handle-biasing spring assembly 62 is shown comprising an inner spindle 64 which is journalled within a round cylindrical cavity formed within the first roller 20. A spring chamber 68 is defined between the inner spindle and the roller 20, and includes a coil spring 70 having crooked ends 72 and 74 which locate in slot arrangements 76 and 78 defined in the respective roller and inner spindle 20 and 64. The inner spindle 64 terminates in a hex stub axle 78 which forms a snug keyed fit within a corresponding hex cavity 79 defined in a side wall 80 of the carriage 18. The roller 20 terminates in a round cylindrical stub axle 81 which locates in a corresponding circular aperture 82 defined in an opposite wall 84 of the carriage 18. The handle, part of which is shown at 26, is formed integrally with the roller 20. As a result, the handle 26 rotates the first roller 20 around the fixed inner spindle 64 against the biasing action of the coil spring 70.

I claim:

1. A device for squeezing a deformable tube having a closed end and nozzle end and containing a material to be dispensed, the device including:

a housing;

mounting means for mounting the tube relative to the housing;

a slide arranged to be moved along a linear path defined in the housing;

a first roller which is rotatably mounted, on a first side of the tube, on the slide about a first axis which is perpendicular to the direction of movement of the slide, the first roller including a first slide advancing face, a first tube squeezing face, a first tube gripping face between the said first slide advancing face and the said first tube squeezing face, and first cog formations;

a second roller which opposes the first roller and which is rotatably mounted, on a second side of the tube opposite to said first side, on the slide about a second axis which is perpendicular to the direction of movement of the slide, the second roller including a second slide advancing face, a second tube squeezing face, a second tube gripping face between the said second slide advancing face and the said second tube squeezing face, and second cog formations, said first cog formations and said second cog formations being intermeshed with each other;

activating means, which acts on the rollers, and which is movable from a rest position at which said first and second slide advancing faces oppose each other on opposing sides of the tube, to a dispensing position whereby the rollers are caused to counter-rotate in respective first directions, relatively to each other, by means of said intermeshed first and second cog formations, said first and second tube squeezing faces are brought into engagement with opposing respective sides of the tube and said first and second tube squeezing faces are also brought into engagement with respective adjacent portions of the tube thereby squeezing material from the tube through the nozzle end; and biasing means for returning the activating means to the rest position whereby the rollers are respectively caused to counter-rotate in respective second directions, which are respectively opposite to said first directions, relatively to each other, and are restored to respective positions at which the first and second slide advancing faces, on opposing sides of the tube, oppose each other with the slide then being movable, to a limited extent, towards the nozzle end to bring said first and second tube gripping faces into contact with respective outer surfaces of the tube.

2. A device according to claim 1, wherein the tube gripping faces include toothed or serrated formations which are arranged to crimp the tube therebetween, with said formations at least partly enmeshing with each other.

3. A device according to claim 1, wherein the positions to which the slide advancing faces of each roller are restored are such that said slide advancing faces lie adjacent a squeezed portion of the tube.

4. A device according to claim 1, wherein the housing is pivotally mounted to a backing plate, the backing plate including a tube retaining base for receiving a neck of the tube.

5. A device according to claim 4, wherein the tube retaining base includes a pair of inwardly projecting arms, the arms being arranged to resiliently splay downwardly and outwardly when the neck of the tube is inserted therein so as to clamp the neck of the tube firmly in position.

* * * * *